US010453638B2

(12) United States Patent
Sasaki et al.

(10) Patent No.: US 10,453,638 B2
(45) Date of Patent: Oct. 22, 2019

(54) OVERCURRENT TRIPPING DEVICE AND CIRCUIT BREAKER EMPLOYING SAME

(71) Applicant: MITSUBISHI ELECTRIC CORPORATION, Chiyoda-ku, Tokyo (JP)

(72) Inventors: Hiroshi Sasaki, Tokyo (JP); Yuta Sagara, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/547,642

(22) PCT Filed: Jun. 13, 2016

(86) PCT No.: PCT/JP2016/067484

§ 371 (c)(1),
(2) Date: Jul. 31, 2017

(87) PCT Pub. No.: WO2016/204104

PCT Pub. Date: Dec. 22, 2016

(65) Prior Publication Data

US 2018/0012720 A1 Jan. 11, 2018

(30) Foreign Application Priority Data

Jun. 19, 2015 (JP) ..... 2015-123505

(51) Int. Cl.
*H01H 73/12* (2006.01)
*H01H 71/24* (2006.01)
(Continued)

(52) U.S. Cl.
CPC .... *H01H 71/2454* (2013.01); *H01H 71/0235* (2013.01); *H01H 71/2463* (2013.01); *H01H 73/36* (2013.01)

(58) Field of Classification Search
CPC ..... H01H 71/02; H01H 71/24
(Continued)

(56) References Cited

U.S. PATENT DOCUMENTS 3,024,330 A 3/1962 Fehling
4,965,543 A 10/1990 Batteux
5,894,257 A * 4/1999 Roger et al. ..... H01H 71/24 335/18

FOREIGN PATENT DOCUMENTS

DE 26 58 456 A1 6/1978
EP 2 431 992 A1 3/2012
(Continued)

OTHER PUBLICATIONS

International Search Report (PCT/ISA/210) dated Sep. 6, 2016, by the Japanese Patent Office as the International Searching Authority for International Application No. PCT/JP2016/067484.
(Continued)

*Primary Examiner* — Shawki S Ismail
*Assistant Examiner* — Lisa N Homza
(74) *Attorney, Agent, or Firm* — Buchanan Ingersoll & Rooney PC

(57) ABSTRACT

An overcurrent tripping device includes a tripping conductor connected to the main circuit; a fixed core inside which the tripping conductor penetrates and which is excited by current flowing through the tripping conductor; a movable core which is arranged to be opposed to the fixed core with a magnetic gap therebetween, and which forms a magnetic circuit in cooperation with the fixed core, and moves by being attracted by the fixed core when overcurrent flows through the tripping conductor; and a shaft fixed to the movable core to guide the movement of the movable core, and linked to the tripping mechanism of the circuit breaker, wherein the fixed core has a narrow gap formed in such a
(Continued)

direction as to cross the magnetic circuit, so that magnetic saturation is suppressed by the narrow gap.

10 Claims, 9 Drawing Sheets

(51) Int. Cl.
*H01H 71/02* (2006.01)
*H01H 73/36* (2006.01)

(58) Field of Classification Search
USPC ..... 335/18
See application file for complete search history.

(56) References Cited

FOREIGN PATENT DOCUMENTS

| | | |
|---|---|---|
| GB | 1 597 508 | 9/1981 |
| JP | 1-315923 A | 12/1989 |

OTHER PUBLICATIONS

Written Opinion (PCT/ISA/237) dated Sep. 6, 2016, by the Japanese Patent Office as the International Searching Authority for International Application No. PCT/JP2016/067484.
Extended European Search Report dated Dec. 10, 2018 in corresponding European Application No. 16811578.0.
Office Action (Examination report No. 1 for standard patent application) dated Feb. 8, 2018, by the Australian Patent Office in corresponding Australian Patent Application No. 2016281164. (3 pages).

* cited by examiner

OVERCURRENT TRIPPING DEVICE AND CIRCUIT BREAKER EMPLOYING SAME

TECHNICAL FIELD

The present invention relates to an overcurrent tripping device for a circuit breaker, and further relates to a circuit breaker using the overcurrent tripping device.

BACKGROUND ART

As a conventional overcurrent tripping device, for example, a configuration shown in FIG. 16 is known. In FIG. 16, when overcurrent flows through a conductor 101 penetrating through the center of the overcurrent tripping device, a magnetic flux is generated in a fixed core 102, to form a magnetic circuit, and a movable core 103 is attracted upward, whereby a shaft 104 fixed to the movable core 103 is moved upward. By the shaft 104 being moved upward, the retention state of a retention latch for a movable contact of a circuit breaker is released, whereby the circuit breaker shifts to an opened state (see, for example, Patent Document 1).

CITATION LIST

Patent Document

Patent Document 1: European Patent Publication No. EP2431992A1 (page 1, FIG. 4)

SUMMARY OF THE INVENTION

Problems to be Solved by the Invention

In the case where a fault occurs on an electric circuit including a circuit breaker and overcurrent flows, in order to reduce damage due to the overcurrent, it is effective to shorten, as much as possible, a time taken until completion of tripping operation from when the overcurrent occurs. In order to shorten the time taken until completion of tripping operation, in an overcurrent tripping device, a tripping drive force due to the overcurrent needs to greatly exceed a drive force at a current scale value (current prescribed value to start tripping operation). There are two methods for increasing the tripping drive force.

The first method is to reduce magnetic saturation of an electromagnet composing the overcurrent tripping device. Since the fault current of the circuit breaker increases transitionally within an extremely short time, a magnetomotive force of the overcurrent tripping device also increases transitionally during occurrence of the fault current, but when the electromagnet composing the overcurrent tripping device is magnetically saturated, the amount of increase in the tripping drive force reduces. Therefore, in order to shorten the tripping operation time, it is necessary to make a core structure in which magnetic saturation is less likely to occur by the fault current.

The second method is to increase a drive force for a movable core forming an electromagnet. A magnetic attraction force acting on the movable core is generated in the same direction as the direction of a magnetic flux passing through the movable core via a magnetic gap from the fixed core. Therefore, in order to increase the drive force for the movable core, it is effective to use a core-and-conductor structure in which the direction of generation of the magnetic attraction force is the same as the driving direction of the movable core.

In the opening mechanism of the circuit breaker shown in Patent Document 1 above, an electromagnet composing the tripping device does not have such a structure as to suppress magnetic saturation when fault current occurs, and thus a measure for shortening the tripping time is insufficient. In order to suppress magnetic saturation in this configuration, it is necessary to increase the sectional area of the core. As a result, the core volume is inevitably increased, leading to a problem of increase in the mass of the entire device.

In addition, since the direction of the magnetic flux passing through the magnetic gap is different from the driving direction of the movable core, there is a problem that the driving force cannot be fully exerted.

The present invention has been made to solve the above problems, and an object of the present invention is to obtain an overcurrent tripping device that enables shortening of the tripping operation time in the case where fault current occurs, and enables size reduction of the device, and a circuit breaker using the overcurrent tripping device.

Solution to the Problems

An overcurrent tripping device according to the present invention detects overcurrent flowing through a main circuit of a circuit breaker and actuates a tripping mechanism of the circuit breaker in a closed state, and includes: a tripping conductor connected to the main circuit; a fixed core inside which the tripping conductor penetrates and which is excited by current flowing through the tripping conductor; a movable core which is arranged to be opposed to the fixed core with a magnetic gap therebetween, and which forms a magnetic circuit in cooperation with the fixed core, and moves by being attracted by the fixed core when overcurrent flows through the tripping conductor; and a shaft fixed to the movable core to guide the movement, and linked to the tripping mechanism of the circuit breaker, wherein the fixed core or the movable core has a narrow gap formed in such a direction as to cross the magnetic circuit.

A circuit breaker according to the present invention includes: an arc-extinguishing chamber in which an arc-extinguishing space is formed; a fixed-side main contact located under the arc-extinguishing chamber; a movable-side main contact located so as to be contactable with and separable from the fixed-side main contact; and an overcurrent tripping device which detects overcurrent flowing between the fixed-side main contact and the movable-side main contact and drives the movable-side main contact in a tripping direction, wherein, as the overcurrent tripping device, the above overcurrent tripping device is used.

Effect of the Invention

In the overcurrent tripping device of the present invention, the fixed core or the movable core which forms a magnetic circuit has a narrow gap formed in such a direction as to cross the magnetic circuit. Therefore, when fault current flows through the tripping conductor, magnetic saturation is suppressed by the narrow gap, whereby a great drive force is obtained and a response time of the tripping operation can be shortened.

In addition, as compared to the case of not providing a narrow gap, the core volume of the overcurrent tripping device can be reduced, and thus size reduction of the circuit breaker can be achieved.

In the circuit breaker of the present invention, the above overcurrent tripping device is used as an overcurrent tripping device for detecting overcurrent flowing between the fixed-side main contact and the movable-side main contact, and driving the movable-side main contact in the tripping direction. Therefore, when fault current flows between both main contacts, the overcurrent tripping device responds immediately, and thus it is possible to obtain a circuit breaker that enables shortening of the tripping operation time.

DESCRIPTION OF EMBODIMENTS

Embodiment 1

Figure 1:
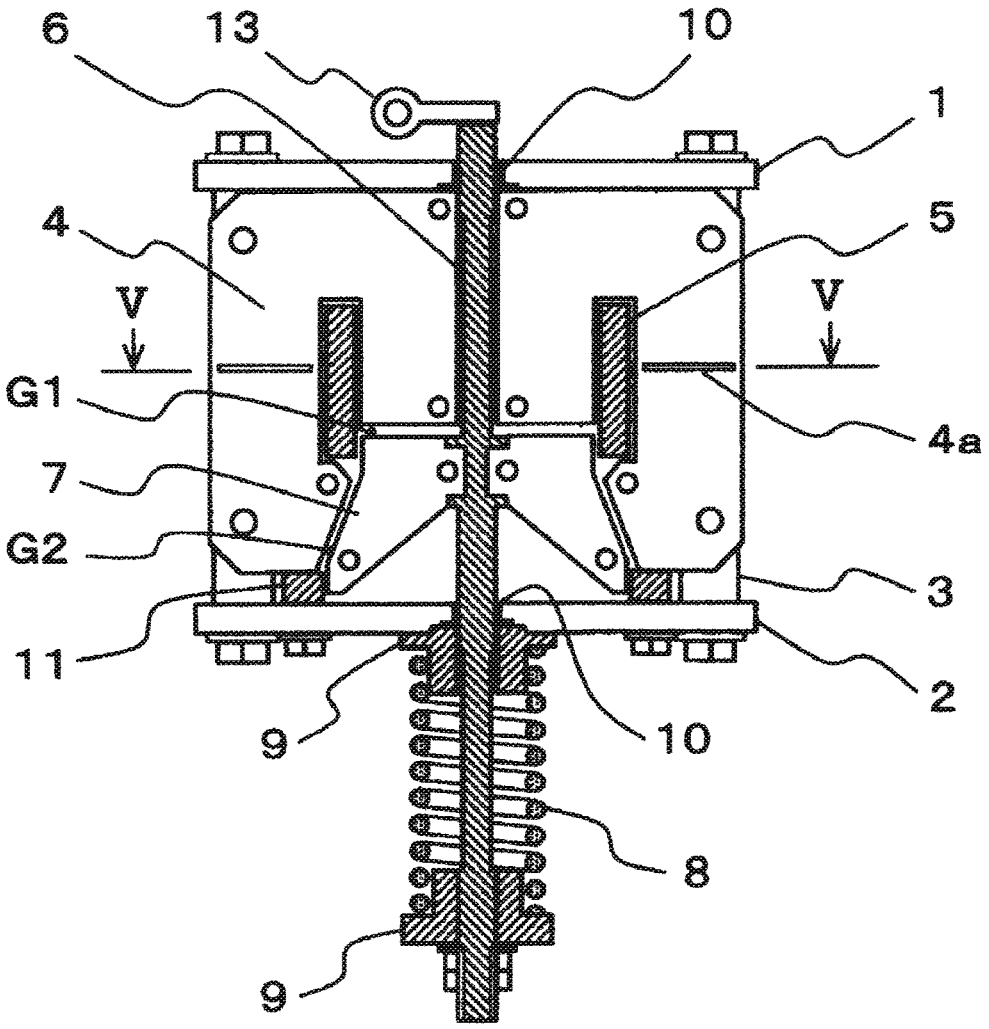
FIG. 1 is a front sectional view showing an overcurrent tripping device according to embodiment 1 of the present invention before tripping operation.
Figure 2:
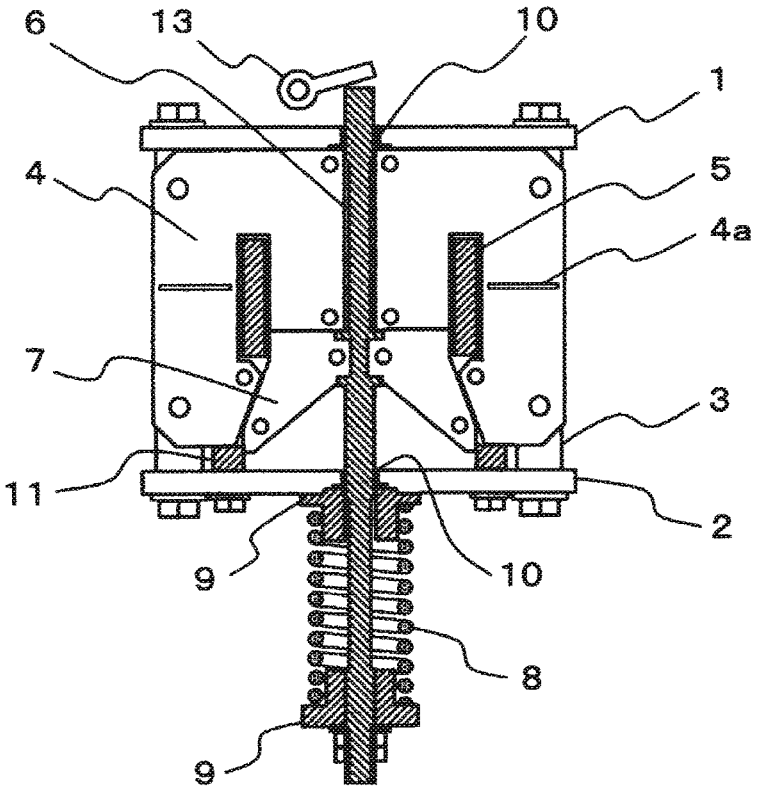
FIG. 2 is a front sectional view showing the overcurrent tripping device according to embodiment 1 of the present invention after tripping operation.
Figure 3:
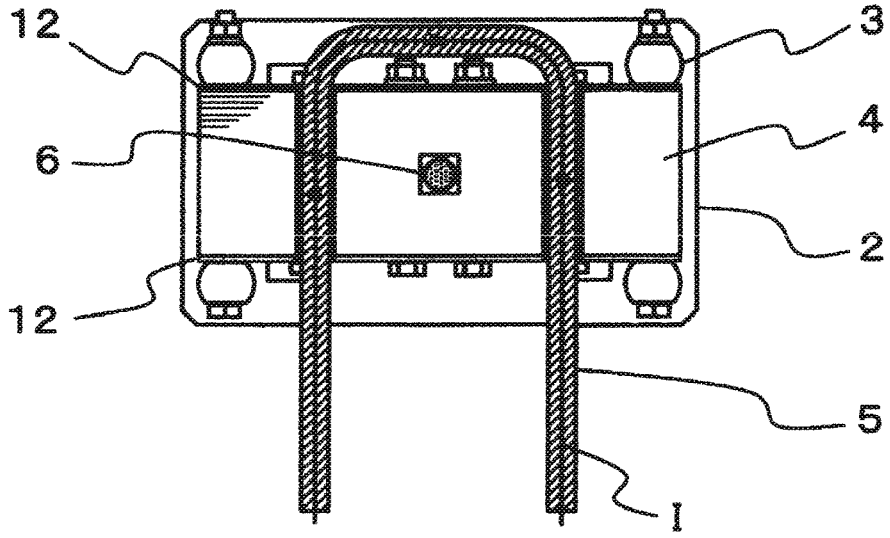
FIG. 3 is a plan sectional view of the overcurrent tripping device in FIG. 1.

FIG. 1 and FIG. 2 are front sectional views of an overcurrent tripping device according to embodiment 1. FIG. 1 shows a state before tripping operation, and FIG. 2 shows a state after tripping operation. FIG. 3 is a plan sectional view.

First, an outline configuration of the overcurrent tripping device will be described with reference to FIG. 1 to FIG. 3. The overcurrent tripping device includes: a fixed core 4 supported by an upper bearing plate 1, a lower bearing plate 2, and a pillar 3; a tripping conductor 5 formed in a U shape and penetrating through the fixed core 4; a shaft 6 penetrating through the centers of the upper bearing plate 1, the lower bearing plate 2, and the fixed core 4 and provided so as to be movable in the axial direction; and a movable core 7 which is fixed to the shaft 6 and moves upward and downward together with the shaft 6. It is noted that the fixed core 4 and the movable core 7 are each formed as a stacked core obtained by stacking magnetic steel sheets.

A return spring 8 is provided to a part, of the shaft 6, that protrudes downward of the lower bearing plate 2, and the upper and lower ends of the return spring 8 are fixed by spring guides 9. By the return spring 8, the movable core 7 is energized, via the shaft 6, in a direction away from the fixed core 4. Bushes 10 for smooth movement are provided at parts where the shaft 6 penetrates through the upper bearing plate 1 and the lower bearing plate 2.

A movable core guide 11 for guiding the movable core 7 is provided on the upper surface of the lower bearing plate 2, and covers 12 are provided at the front and back surfaces of the fixed core 4 as shown in FIG. 3. The overcurrent tripping device is formed by the above members.

It is noted that the upper end of the shaft 6 is engaged with a retention latch 13 described later.

Further, the details of the structure of each part will be described.

As shown in FIG. 1 and FIG. 2, the fixed core 4 is formed substantially in an E shape as seen from the front side, and the tripping conductor 5 is inserted into two slots inside the fixed core 4.

The fixed core 4 and the movable core 7 are formed right-left symmetrically with respect to the shaft 6 passing through the center, as seen from the direction of FIG. 1. Before tripping operation as shown in FIG. 1, an upper surface and both side surfaces of the movable core 7 are opposed to a center lower surface and inner oblique surfaces of the fixed core 4, with predetermined gaps (magnetic gap G1 and magnetic gaps G2) therebetween. After tripping operation as shown in FIG. 2, these surfaces are in almost close contact with each other.

The initial load of the return spring 8 is set to be equal to an electromagnetic drive force at a current scale value (predetermined setting value) of the overcurrent tripping device.

As a feature of embodiment 1 of the present invention, the fixed core 4 has slit-shaped narrow gaps 4*a* at a certain location on a magnetic circuit which is a passage of a magnetic flux generated when current flows through the tripping conductor 5, and the slit-shaped narrow gaps 4*a* are formed so as to interrupt the magnetic circuit, i.e., in a direction perpendicular to the magnetic circuit. In the drawings, these gaps are formed at two locations at the right and left, and the details thereof will be described later.

As shown in FIG. 3, the tripping conductor 5 penetrating through the overcurrent tripping device penetrates through two locations in the fixed core 4 by bending back in a U shape so as to have at least one turn with respect to the magnetic circuit formed by the fixed core 4 and the movable core 7. Main circuit current of the circuit breaker flows through the tripping conductor 5. Owing to the bending-back structure, a magnetomotive force induced in the overcurrent tripping device increases as compared to a no-turn structure (in which current flows in one direction). Therefore, a drive force due to increase in overcurrent also increases, whereby the tripping operation time can be shortened.

Here, the term "one turn" includes the case where the tripping conductor 5 is arranged in a U shape so as to surround the center core part of the fixed core 4 and current flows through two penetration parts in a reciprocating manner, as shown in FIG. 3.

Next, tripping operation by the overcurrent tripping device will be described.

When fault current I flows through the tripping conductor 5 and then an electromagnetic attraction force acting on the movable core 7 becomes greater than the load of the return spring 8, the movable core 7 moves from an initial position in FIG. 1 to a tripping position in FIG. 2, whereby the shaft 6 is moved upward in the drawings and an end thereof turns the retention latch 13 to release the latch. Thus, the tripping mechanism of the circuit breaker connected to the retention latch 13 is actuated and the circuit breaker is brought into an opened state.

Next, the details and effects of the narrow gaps 4*a* will be described.

Figure 4:
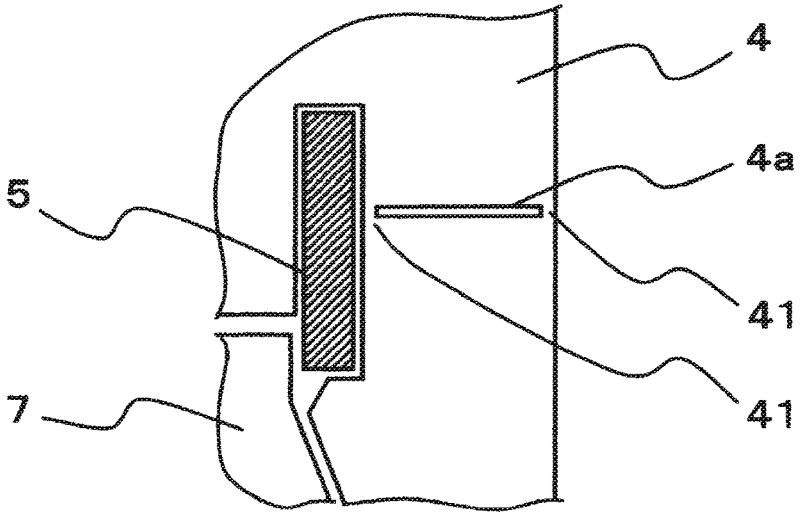
FIG. 4 is a partial detail view of a narrow gap part provided in a fixed core of the overcurrent tripping device in FIG. 1.
Figure 5:
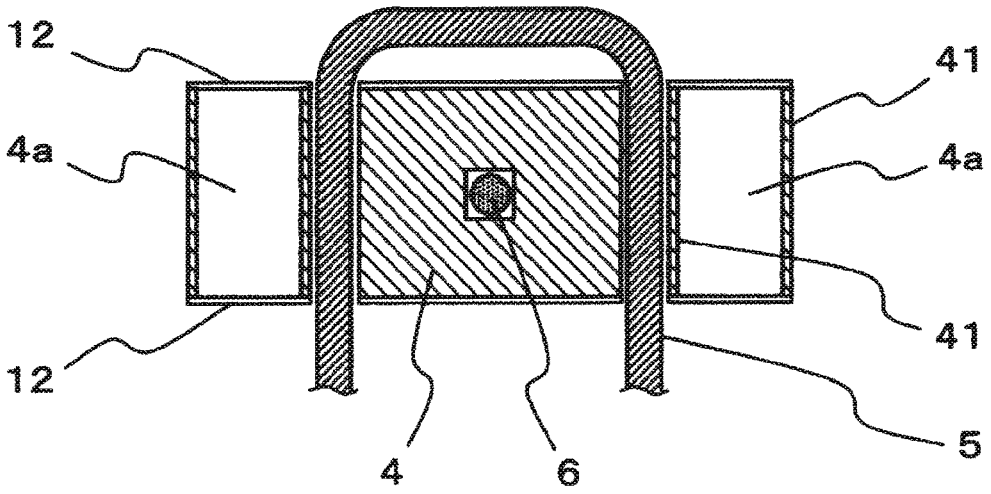
FIG. 5 is a plan sectional view of the narrow gap part provided in the fixed core of the overcurrent tripping device in FIG. 1.
Figure 6:
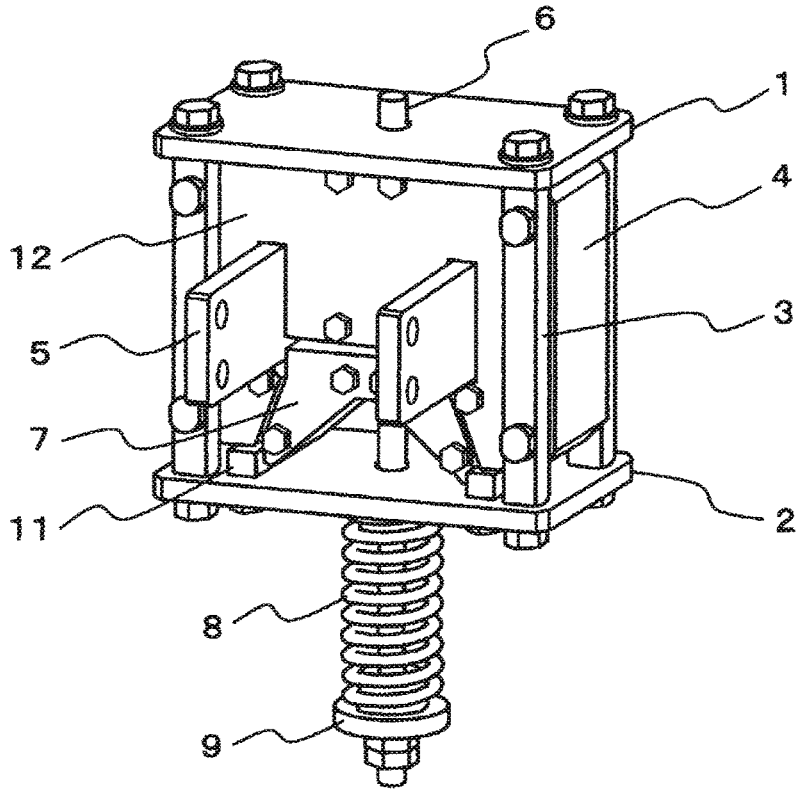
FIG. 6 is a perspective view of the overcurrent tripping device according to embodiment 1 of the present invention.

FIG. 4 is a partial detail view for explaining the narrow gaps 4*a* provided in the fixed core 4, and is an enlarged view of the narrow gap 4*a* part in FIG. 1. FIG. 5 is a plan sectional view of V-V part in FIG. 1. FIG. 6 is a perspective view of FIG. 1.

The narrow gap 4*a* has narrow gap both-end portions 41 at both ends in the width direction so that the dimension thereof does not change due to the magnetic attraction force. As a manufacturing method in the case of FIG. 4, for example, the narrow gap 4*a* is formed by die cutting at the same time as manufacturing of the fixed core 4.

By employing such a structure, provision of additional parts, support parts, and the like due to provision of the narrow gaps 4*a* can be avoided, and thus increase in the number of components is suppressed. As shown in FIG. 5 and FIG. 6, the covers 12 which do not have such narrow gaps 4*a* and which are made of nonmagnetic material are provided on the front and back surfaces of the fixed core 4, whereby impurities are prevented from entering the narrow gaps 4*a*.

The narrow gaps 4*a* serve as magnetic resistance against a magnetic flux passing through the fixed core 4 and the movable core 7, and have an effect of suppressing magnetic saturation of the fixed core 4 when fault current I flows through the tripping conductor 5. Therefore, it is possible to obtain a great drive force.

Figure 7:
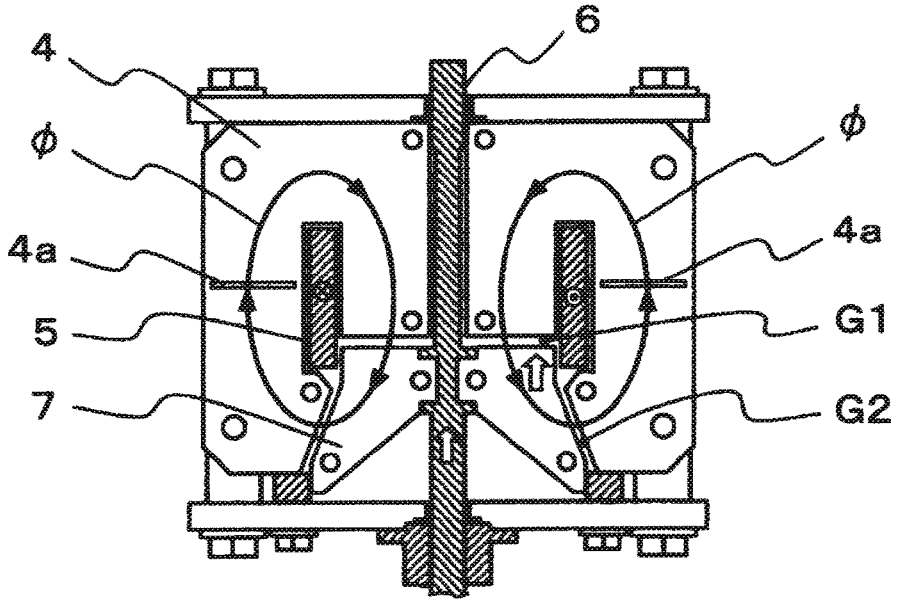
FIG. 7 is a view illustrating a magnetic circuit in the overcurrent tripping device in FIG. 1.

FIG. 7 is a view showing magnetic circuits φ in the core. Magnetic circuits φ as shown by arrows are formed by current flowing through the tripping conductor 5. As described above, each narrow gap 4*a* is provided so as to cross the magnetic circuit φ. The magnetic gap G1 between the fixed core 4 and the movable core 7 is provided in a direction perpendicular to the movement direction of the movable core 7. By employing such a structure, the direction of the electromagnetic attraction force acting on the movable core 7 becomes the same as the driving direction of the movable core 7, whereby increase in the drive force is achieved. Here, the direction of the magnetic gap refers to not the short-side direction of the gap but the longitudinal direction.

Further, the magnetic gaps G2 between the fixed core 4 and the right and left side surfaces of the movable core 7 are obliquely provided so that the resultant force of attraction forces acting on the movable core 7 acts in the movement direction. By employing such a structure, the drive force acting in the movement direction of the movable core 7 increases, whereby the tripping operation time can be shortened.

Figure 16:
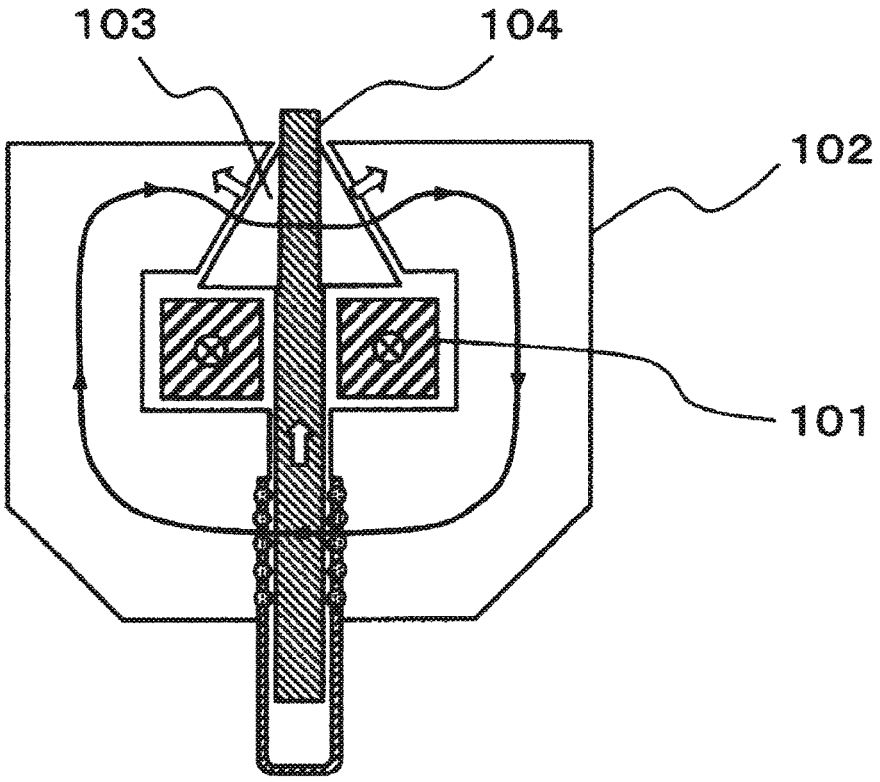
FIG. 16 is a front sectional view illustrating a conventional overcurrent tripping device.

Comparing this structure with a conventional structure as shown in FIG. 16 as an example, in FIG. 16, no narrow gap is provided in a fixed core 102, and the direction of an electromagnetic attraction force acting on a movable core 103 is different from the driving direction of a shaft 104 driven by the movable core 103. Thus, the attraction force is not fully utilized as the drive force. On the other hand, in the structure in embodiment 1, magnetic saturation of the electromagnet is reduced, and in addition, the drive force of the movable core 7 is increased. Therefore, the tripping operation time can be greatly shortened as compared to the structure as shown in FIG. 16.

Figure 8:
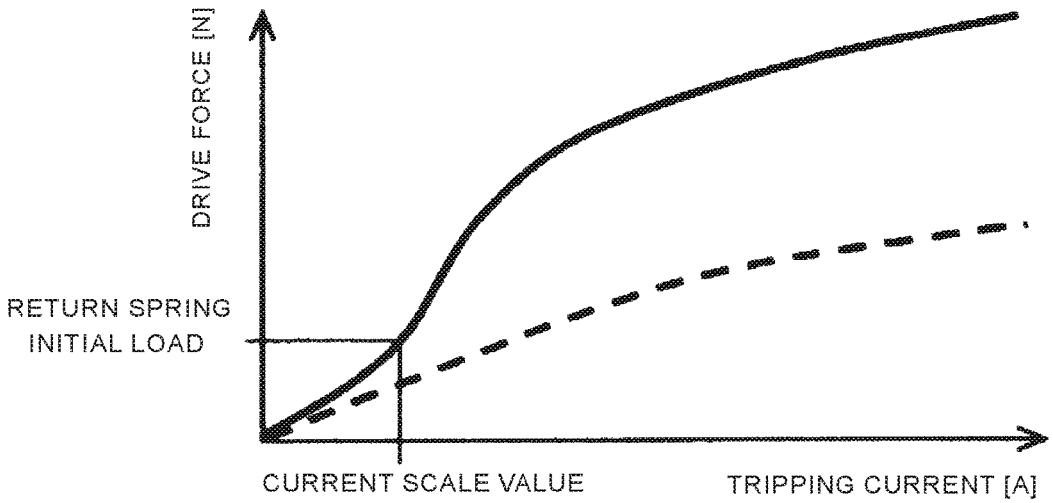
FIG. 8 is a diagram for explaining a drive force of the overcurrent tripping device according to embodiment 1 of the present invention.

FIG. 8 is a diagram for explaining the drive force of the overcurrent tripping device according to embodiment 1 of the present invention, and shows the relationship between the drive force and tripping current flowing through the tripping conductor 5. The predetermined setting value (current scale value) for actuating the movable core 7 corresponds to the initial load of the return spring 8. A solid line indicates the case of embodiment 1 and represents characteristics in which the amount of increase in the drive force is great, while a broken line represents characteristics in which the current increase amount is small as in the conventional technique, for example. In a region in which the current is greater than the current scale value, the operation time of the overcurrent tripping device is shortened as the amount of increase in the drive force becomes greater. Thus, it is found that the overcurrent tripping device of embodiment 1 provides an effect of shortening the operation time of the tripping device.

Figure 9:
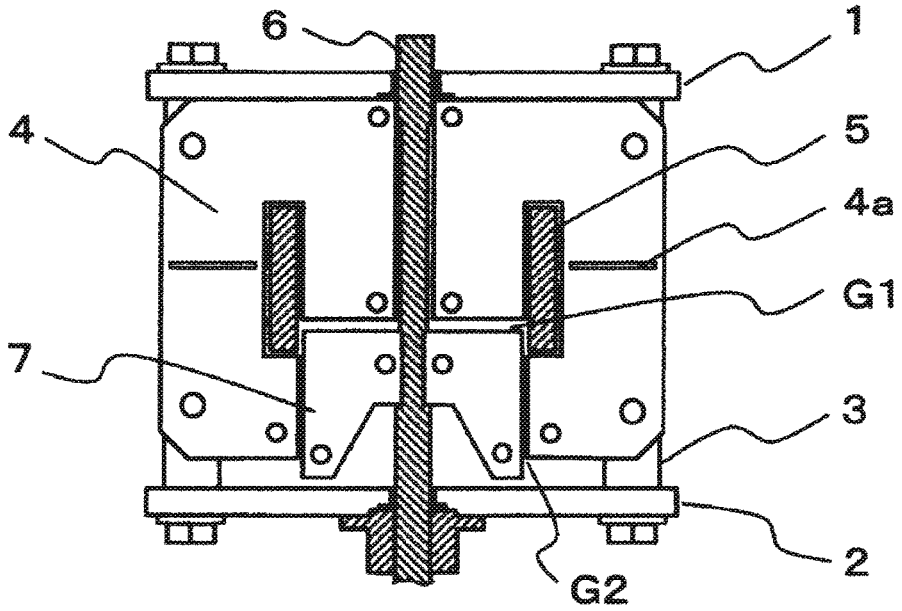
FIG. 9 is a front sectional view showing another example of the overcurrent tripping device according to embodiment 1 of the present invention.

As described above, the magnetic gaps G2 between the fixed core 4 and both side surfaces of the movable core 7 are provided in an inclined manner to increase the drive force. However, as shown in FIG. 9, without inclining both side surfaces of the movable core 7, the magnetic gaps G2 may be formed in parallel to the driving direction, that is, the magnetic gaps G2 may be formed perpendicularly to the magnetic gap G1. In this case, the same effect as in FIG. 1 can be expected except that increase in the drive force due to the magnetic gap G2 part cannot be obtained.

Figure 10A:
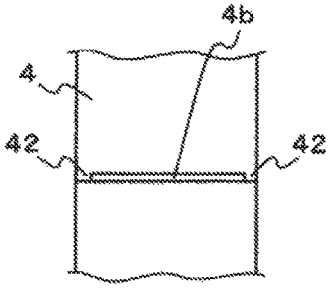
FIGS. 10A to 10C are partial detail views showing other configurations of a narrow gap part in the overcurrent tripping device according to embodiment 1 of the present invention.
Figure 10B:
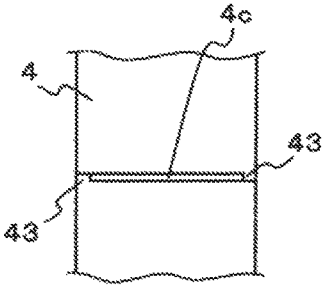
Figure 10C:
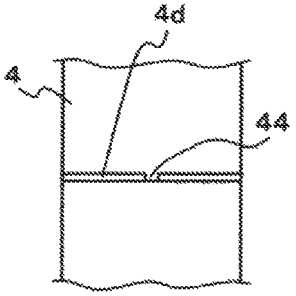

Next, other examples of the narrow gap structure will be described. FIGS. 10A to 10C are partial detail views illustrating other configurations of the narrow gap part provided in the fixed core 4, and shows only the narrow gap part.

A narrow gap 4*b* in FIG. 10A is formed by dividing the fixed core 4 at a part where the narrow gap 4*b* is provided, providing a U-shaped cutout in one of the division surfaces, and using projections 42 at both ends thereof as both-end connection parts of the narrow gap 4*b*.

A narrow gap 4*c* in FIG. 10B is formed by dividing the fixed core 4 at a part where the narrow gap 4*c* is provided, providing a projection 43 at one end side in the width direction of each division surface, and combining the divided surfaces such that the respective projections 43 are positioned at the right and left.

A narrow gap 4*d* in FIG. 10C is formed by dividing the fixed core 4 at a part where the narrow gap 4*d* is provided, providing a projection 44 at the center of one of the division surfaces, and combining the division surfaces.

In any case, the heights of the projections are matched to the interval of the narrow gap.

Even in such a narrow gap structure, the same effect as in the case of narrow gap 4*a* shown in FIG. 4 can be obtained, and small materials can be utilized in manufacturing of the core and thus materials can be effectively utilized.

In the examples in FIGS. 10A to 10C, a projection is formed on an end surface of one or both of the two divided fixed cores 4, and the narrow gaps 4*b* to 4*d* are formed with each projection in contact with the end surface of the opposed fixed core 4. However, instead of the projections 42 to 44, separately from the fixed cores 4, a line-shaped member (not shown) having a round or polygonal cross section may be interposed between the end surfaces of the two divided fixed cores 4, thereby forming the narrow gaps 4*b* to 4*d*. Even in such a configuration, the same effect as in the case of the narrow gaps shown in FIG. 4 can be obtained, and further, waste of materials is avoided in manufacturing of the narrow gaps.

Next, a circuit breaker 51 using the overcurrent tripping device according to embodiment 1 of the present invention will be described.

Figure 11:
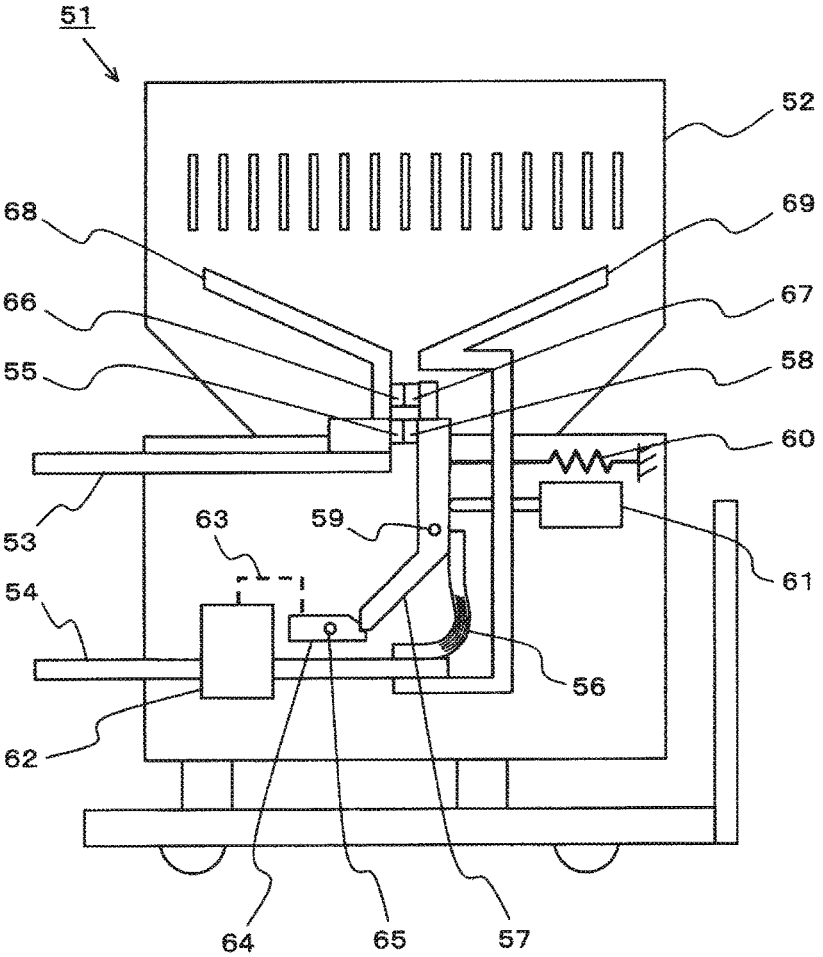
FIG. 11 is a front sectional view showing an outline configuration of a circuit breaker using the overcurrent tripping device according to embodiment 1 of the present invention.

FIG. 11 is a front sectional view showing an outline configuration of the circuit breaker 51 in a schematic manner. As shown in FIG. 11, in the circuit breaker 51, a fixed-side conductor 53 and a movable-side conductor 54 are arranged under an arc-extinguishing chamber 52 in which an arc-extinguishing space is formed when current flows.

A fixed-side main contact 55 is connected to the fixed-side conductor 53. The movable-side conductor 54 is connected to a movable element 57 via a flexible conductor 56, and a movable-side main contact 58 is provided at a position opposed to the fixed-side main contact 55, at an end of the movable element 57.

The movable element 57 rotates about a rotary shaft 59. An opening operation is performed by an opening spring 60, and a closing operation is performed by an actuator 61. When the fixed-side main contact 55 and the movable-side main contact 58 are brought into contact with each other, current flows between the fixed-side conductor 53 and the movable-side conductor 54 via the movable element 57 and the flexible conductor 56.

An overcurrent tripping device 62 is provided at a certain location on the movable-side conductor 54. As the overcurrent tripping device 62, the overcurrent tripping device of embodiment 1 described above is used.

The tripping conductor 5 of the overcurrent tripping device 62 is connected to the movable-side conductor 54, and main circuit current flows through the tripping conductor 5. The overcurrent tripping device 62 is engaged with a latch 64 via a latch driving link 63. Here, the latch driving link 63 indicated by a broken line in FIG. 11 corresponds to a part for transmitting movement of the shaft 6 of the overcurrent tripping device to the retention latch 13 as described above in FIG. 1, and on the basis of this operation, the latch 64 is driven.

Next, operation when fault current flows will be described.

When fault current flows, the overcurrent tripping device 62 provided to the movable-side conductor 54 detects overcurrent and performs operation, and the operation is transmitted to the latch 64 via the latch driving link 63. Then, the latch 64 rotates about a latch shaft 65 in the clockwise direction, whereby engagement with the movable element 57 is released and the movable element 57 rotates about the rotary shaft 59 in the clockwise direction, thus performing an opening operation.

The fixed-side main contact 55 and the movable-side main contact 58 are stored inside the arc-extinguishing chamber 52. Above the fixed-side main contact 55 and the movable-side main contact 58, a fixed-side arc contact element 66 and a movable-side arc contact element 67 are provided and an arc is generated upon interruption.

In an opening operation, the fixed-side arc contact element 66 and the movable-side arc contact element 67 are opened later after the fixed-side main contact 55 and the movable-side main contact 58 are opened. Thus, an arc is prevented from being generated at the fixed-side main contact 55 and the movable-side main contact 58, and erosion of the main contact part is prevented, whereby the main contact part is protected.

Above the fixed-side arc contact element 66 and the movable-side arc contact element 67, a fixed-side arc horn 68 and a movable-side arc horn 69 are provided for transferring the generated arc and leading the arc upward in the arc-extinguishing chamber 52.

The configuration of the circuit breaker 51 shown in FIG. 11 is merely an example, and is not limited thereto. Basically, it is possible to employ any configuration in which the overcurrent tripping device 62 detects current flowing through the main circuit of the circuit breaker 51, and by the operation thereof, engagement between the movable element 57 and the latch 64 is released to bring the circuit breaker 51 into an opened state.

As the overcurrent tripping device 62, the one having a configuration described in embodiment 2 or later may be used.

As described above, the overcurrent tripping device of embodiment 1 detects overcurrent flowing through a main circuit of a circuit breaker and actuates a tripping mechanism of the circuit breaker in a closed state, and includes: a tripping conductor connected to the main circuit; a fixed core inside which the tripping conductor penetrates and which is excited by current flowing through the tripping conductor; a movable core which is arranged to be opposed to the fixed core with a magnetic gap therebetween, and which forms a magnetic circuit in cooperation with the fixed core, and moves by being attracted by the fixed core when overcurrent flows through the tripping conductor; and a shaft fixed to the movable core to guide movement thereof, and linked to the tripping mechanism of the circuit breaker, wherein the fixed core or the movable core has a narrow gap formed in such a direction as to cross the magnetic circuit. Therefore, when fault current flows through the tripping conductor, magnetic saturation is suppressed by the narrow gap, whereby a great drive force is obtained and a response time of the tripping operation can be shortened.

In addition, as compared to the case of not providing a narrow gap, the core volume of the overcurrent tripping device can be reduced, and thus size reduction of the circuit breaker can be achieved.

The narrow gap may be formed by dividing the fixed core or the movable core at a part where the narrow gap is formed, providing projections on the division surfaces, and combining the division surfaces. In this case, in addition to the above effect, waste of materials in manufacturing of the core can be reduced.

The tripping conductor is arranged to penetrate through the fixed core so as to have at least one turn with respect to the fixed core, whereby a magnetic drive force of the movable core is increased and the tripping operation time can be further shortened.

The magnetic gap has a part formed in a direction perpendicular to the movement direction of the movable core. Thus, the direction of an electromagnetic attraction force acting on the movable core is the same as the driving direction of the movable core, and increase in the drive force can be achieved. Therefore, the tripping operation time can be shortened.

The circuit breaker of embodiment 1 includes: the arc-extinguishing chamber in which an arc-extinguishing space is formed; the fixed-side main contact provided under the arc-extinguishing chamber; the movable-side main contact provided so as to be contactable with and separable from the fixed-side main contact; and the overcurrent tripping device which detects overcurrent flowing between the fixed-side main contact and the movable-side main contact and drives the movable-side main contact in the tripping direction, wherein the overcurrent tripping device is any of the overcurrent tripping devices described above. Therefore, when fault current flows between both main contacts, the overcurrent tripping device responds immediately, and thus it is possible to obtain a circuit breaker that enables shortening of the tripping operation time.

Embodiment 2

Figure 12:
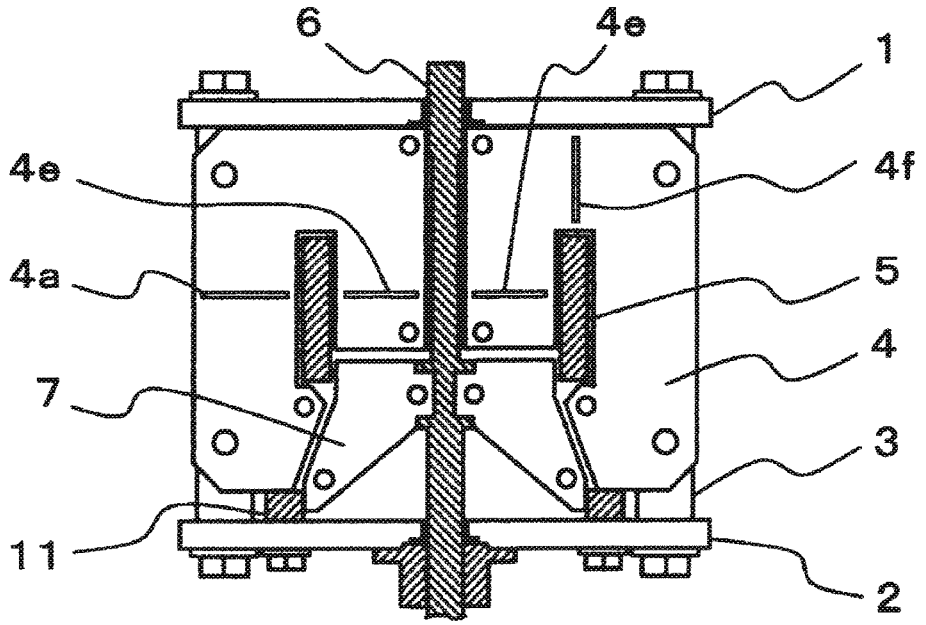
FIG. 12 is a front sectional view of an overcurrent tripping device according to embodiment 2 of the present invention.
Figure 13:
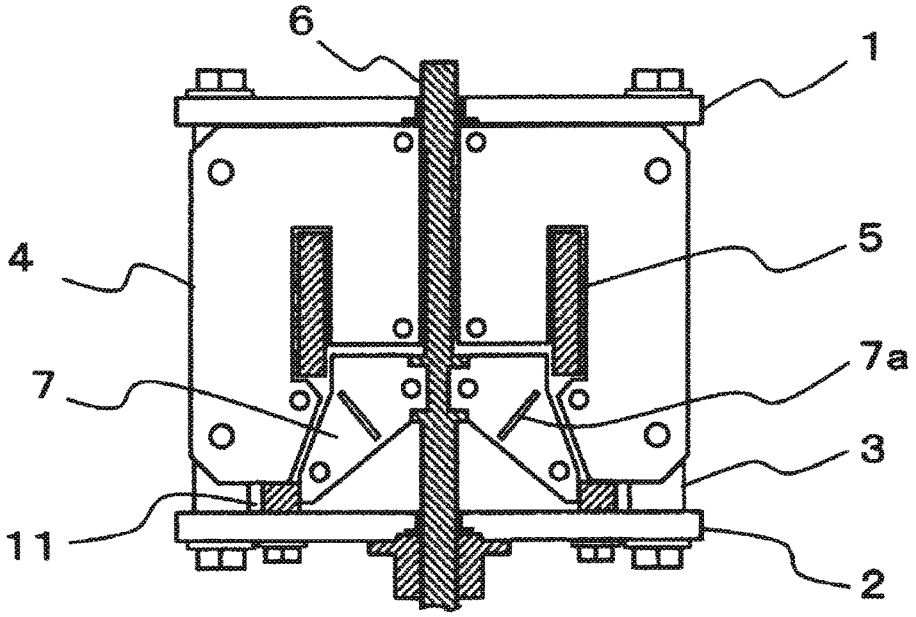
FIG. 13 is a front sectional view showing another example of the overcurrent tripping device according to embodiment 2 of the present invention.

FIG. 12 and FIG. 13 are front sectional views of an overcurrent tripping device according to embodiment 2. These views correspond to FIG. 1 in embodiment 1. Therefore, parts equivalent to those in FIG. 1 are denoted by the same reference characters and the description thereof is omitted, and a difference therebetween will be mainly described. The difference is the positions at which the narrow gaps are provided.

FIG. 12 shows the case of providing four narrow gaps in the fixed core 4. The four narrow gaps are as follows: the same narrow gap 4*a* as in FIG. 1, two narrow gaps 4*e* located close to the shaft 6, and a narrow gap 4*f* located above the tripping conductor 5.

FIG. 13 is a front sectional view of an overcurrent tripping device in another example of embodiment 2. In this example, two narrow gaps 7*a* are provided in the movable core 7.

Thus, the positions and the number of the narrow gaps to be provided can be arbitrarily selected somewhere on magnetic route in the fixed core 4 or the movable core 7, and the pattern of the narrow gaps may not necessarily be right-left symmetric with respect to the shaft 6 passing through the center of the core. Even in the configuration shown in FIG. 12 or FIG. 13, as for suppression of magnetic saturation, the same effect as in embodiment 1 can be obtained.

Embodiment 3

Figure 14:
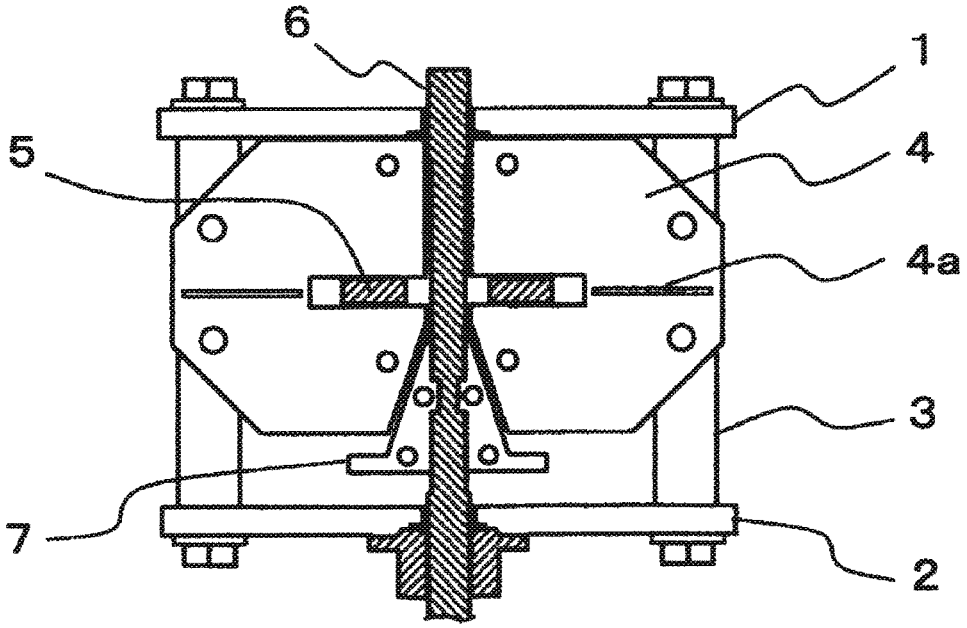
FIG. 14 is a front sectional view of an overcurrent tripping device according to embodiment 3 of the present invention.
Figure 15:
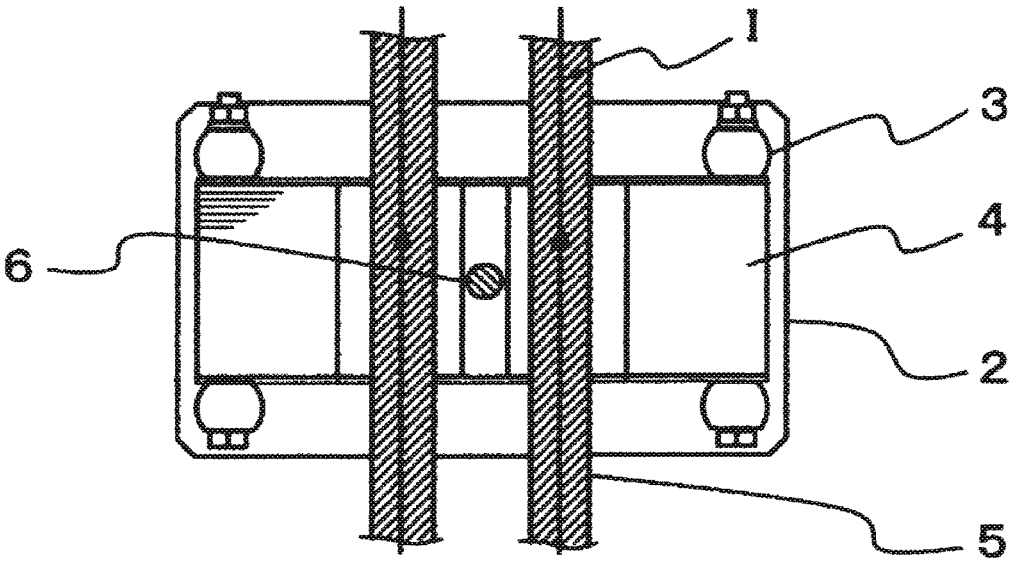
FIG. 15 is a plan sectional view of the overcurrent tripping device in FIG. 14.

FIG. 14 is a front sectional view of an overcurrent tripping device according to embodiment 3, and FIG. 15 is a plan sectional view of FIG. 14. These views correspond to FIG. 1 and FIG. 3 in embodiment 1. Therefore, equivalent parts are denoted by the same reference characters and the description thereof is omitted, and a difference therebetween will be mainly described.

As shown in FIG. 14 and FIG. 15, in the present embodiment, the tripping conductor 5 penetrating through the overcurrent tripping device is configured so that currents flow in an identical direction, instead of having at least one turn. In this case, it is not necessary to form the tripping conductor 5 in a U shape. Therefore, the height dimension can be reduced by arranging the tripping conductor 5 with its surface facing in a direction perpendicular to the driving direction of the shaft 6.

Even in such a configuration, since the narrow gaps 4*a* are provided in the fixed core 4, the effect of suppressing magnetic saturation by the narrow gaps 4*a* is obtained as in embodiment 1. Thus, the configuration in which the slit-shaped narrow gaps 4*a* are provided in the fixed core 4, and the configuration in which the tripping conductor 5 has at least one turn, may not necessarily be employed at the same time. Even if each configuration is employed alone, the corresponding effect can be obtained.

The locations and the shapes of the magnetic gaps to be provided may be the same as in FIG. 1. By using the same shapes as in FIG. 1, the drive force acting in the movement direction of the movable core 7 increases, and thus it is possible to obtain a greater drive force.

It is noted that, within the scope of the present invention, the above embodiments may be freely combined with each other, or each of the above embodiments may be modified or simplified as appropriate.

DESCRIPTION OF THE REFERENCE CHARACTERS

1 upper bearing plate
2 lower bearing plate
3 pillar
4 fixed core
4*a*, 4*b*, 4*c*, 4*d*, 4*e*, 4*f* narrow gap
5 tripping conductor
6 shaft
7 movable core
7*a* narrow gap
8 return spring
9 spring guide
10 bush
11 movable core guide
12 cover
13 retention latch
41 narrow gap both-end portions
42, 43, 44 projection
51 circuit breaker
52 arc-extinguishing chamber
53 fixed-side conductor
54 movable-side conductor
55 fixed-side main contact
56 flexible conductor
57 movable element
58 movable-side main contact
59 rotary shaft
60 opening spring
61 actuator
62 overcurrent tripping device
63 latch driving link
64 latch
65 latch shaft
66 fixed-side arc contact element
67 movable-side arc contact element
68 fixed-side arc horn
69 movable-side arc horn
G1, G2 magnetic gap
I fault current
φ magnetic circuit

The invention claimed is:

1. An overcurrent tripping device for detecting overcurrent flowing through a main circuit of a circuit breaker and for actuating a tripping mechanism of the circuit breaker in a closed state, the overcurrent tripping device comprising:

a tripping conductor connected to the main circuit;

a fixed core inside which the tripping conductor penetrates and which is excited by current flowing through the tripping conductor;

a movable core which is arranged to be opposed to the fixed core with a magnetic gap therebetween, and which forms a magnetic circuit in cooperation with the fixed core, and moves by being attracted by the fixed core when overcurrent flows through the tripping conductor;

a shaft fixed to the movable core to guide the movement, and linked to the tripping mechanism of the circuit breaker; and a narrow gap formed in the fixed core, the narrow gap being formed in a direction so as to cross the magnetic circuit.

2. The overcurrent tripping device according to claim 1, wherein the narrow gap is formed by dividing the fixed core at a part where the narrow gap is formed, providing projections on division surfaces thereof, and combining the division surfaces.

3. The overcurrent tripping device according to claim 1, wherein the tripping conductor is arranged to penetrate through the fixed core so as to have at least one turn with respect to the fixed core.

4. The overcurrent tripping device according to claim 1, wherein the magnetic gap has a part formed in a direction perpendicular to a movement direction of the movable core.

5. A circuit breaker comprising:

an arc-extinguishing chamber in which an arc-extinguishing space is formed;

a fixed-side main contact located under the arc-extinguishing chamber;

a movable-side main contact located so as to be contactable with and separable from the fixed-side main contact; and an overcurrent tripping device which detects overcurrent flowing between the fixed-side main contact and the movable-side main contact and drives the movable-side main contact in a tripping direction, wherein the overcurrent tripping device is the overcurrent tripping device according to claim 1.

6. The overcurrent tripping device according to claim 1, wherein the fixed core including the narrow gap has abutting solid portions on both longitudinal ends of the gaps.

7. The overcurrent tripping device according to claim 1, comprising:

a narrow gap formed in the movable core, the narrow gap formed in the movable core being formed in a direction so as to cross the magnetic circuit.

8. The overcurrent tripping device according to claim 7, wherein the narrow gap in the movable core is formed by dividing the movable core at a part where the narrow gap is formed, providing projections on division surfaces thereof, and combining the division surfaces.

9. The overcurrent tripping device according to claim 7, wherein the movable core including the narrow gap has abutting solid portions on both longitudinal ends of the gaps.

10. The overcurrent tripping device according to claim 1, wherein the magnetic gap includes a first magnetic gap arranged between oblique side surfaces of the movable core and oblique inner surfaces of the fixed core.

* * * * *